United States Patent [19]

Hilal

[11] Patent Number: 4,966,884

[45] Date of Patent: Oct. 30, 1990

[54] DC POWERED HYBRID COIL GUN EMPLOYING SUPERCONDUCTING ELEMENTS

[75] Inventor: Mohammed A. Hilal, Madison, Wis.

[73] Assignee: International Superconductor Corp., Riverdale, N.Y.

[21] Appl. No.: 300,282

[22] Filed: Jan. 19, 1989

[51] Int. Cl.[5] ..... F41B 6/00

[52] U.S. Cl. ..... 505/1; 89/8; 124/3; 505/876

[58] Field of Search ..... 89/8; 124/3; 310/13; 505/876, 1

[56] References Cited

U.S. PATENT DOCUMENTS 2,870,675 1/1959 Salisbury ..... 89/8

4,432,333 2/1984 Kurherr ..... 89/8

FOREIGN PATENT DOCUMENTS 1332109 6/1963 France ..... 89/7

*Primary Examiner*—Stephen C. Bentley

*Attorney, Agent, or Firm*—Herbert Dubno

[57] ABSTRACT

A device and apparatus, consisting of a standard barrel, a superconductive magnet winding wrapped around the barrel, a large mass piston and a projectile. This device is a direct-current powered hybrid coil gun which operates to accelerate projectiles to high velocity without the requirement of gigawatt power pulses. The device also lowers the cost of power required per shot and makes possible extended life of the individual parts of the apparatus.

18 Claims, 5 Drawing Sheets

DC POWERED HYBRID COIL GUN EMPLOYING SUPERCONDUCTING ELEMENTS

FIELD OF THE INVENTION

My present invention relates to direct-current powered hybrid coil guns employing superconducting coils, and to a method of operating same.

BACKGROUND OF THE INVENTION

The history of guns and projectiles dates back at least several thousand years to the original discovery of gunpowder in China. Gunpowder is essentially a mixture of solid chemicals comprised of an oxidizing agent plus reducing agents capable of being oxidized. If gunpowder is confined in a small space in conjunction with a projectile, i.e. a "bullet", and is then detonated, chemical energy changes the solids to hot gases almost instantaneously, and the chemical energy is converted to kinetic energy, causing the projectile to accelerate.

In yet another version of a gun, the projectile is accelerated by the use of coils situated on a barrel in such a manner that the the coils can be energized in turn to produce an electromagnetic field and thereby accelerate the the projectile.

Electromagnetic and coil guns of prior art designs require gigawatt electric power supplies to operate. The weight and the complexity of these power supplies severely limits the potential use of these guns. It is prohibitive to use these guns for systems which require low weight such as space borne weapons or mobile systems.

The development of electromagnetic guns has also been hindered by the factor of severe rail erosion. It is not clear after many year of development whether such problems can be overcome. The most advanced rails developed to date are limited to a few shots. Yet weapon systems employing electromagnetic and coil guns require that at least a few hundred shots be delivered without barrel replacement to be satisfactory.

OBJECTS OF THE INVENTION

It is an object of the invention to provide an improved electromagnetic gun which eliminates the need for a gigawatt power supply.

I have also to provide a system in which barrel erosion and rail damage is considerably lessened and/or nearly completely eliminated, so much so that the usage of said electromagnetic and coil guns become feasible as a weapon system.

It is a further object to provide a coil gun which does not require the usage of inordinate amounts of powder.

SUMMARY OF THE INVENTION

These objects are attained in accordance with the invention in a hybrid coil gun which comprises:

a projectile formed with at least one closed-loop electromagnet winding;

a piston formed with at least one closed-loop electromagnet winding;

means defining at least one barrel receiving the projectile and from which the projectile can be electromagnetically propelled;

coil means on the barrel having at least a portion magnetically coupling to the closed-loop winding of the projectile for magnetically propelling the projectile from the barrel, the coil means comprising a closed-loop portion generating an external field and magnetically coupling to the closed-loop winding of the piston to decelerate the piston and generate by induction a current pulse for magnetically propelling the projectile; and means for applying a chemical propellant to the piston to drive the piston through the closed-loop portion of the coil means and the external field, whereby the current pulse is induced, the closed-loop portion generating an external field of axially tapering field strength.

The discovery of high critical temperature ceramic compositions having superconducting properties is of recent origin. Originally, superconductivity was observed in mercury at 4 K. by the Dutch scientist, Heike Onnes.

The term, superconductivity, refers to the property wherein a normally resistive conductor abruptly loses all resistance to electrical flow at a specific temperature to, called the critical temperature $T_c$. At this point, the resistivity of the normal conductor becomes zero, and to conductor becomes superconducting. In more recent times, niobium metal alloys have been used in superconducting coils at temperatures up to 23 K. It had previously been believed that superconductivity above 23 K. was not possible. This belief was based on the theoretical work of Bardeen, Cooper and Schieffer (BCS theory-1946) which predicted such a limit. Several theoretical proposals were presented in the 1970's, suggesting that the critical temperature for superconductivity could be increased. However, the lack of any early discoveries of superconductivity above 23 K. solidified the belief that indeed this temperature could not be exceeded.

Thus, in November, 1987, when Bednorz and Müller announced the discovery of a new ceramic superconducting compound based on lanthanum, barium, and copper oxides, whose critical temperature for superconductivity was close to 35 K., (G. Bednorz and A. Müller, Z. Phys., B64 189 (1986)), the declaration was greeted with considerable scepticism. Nevertheless, by the following month, the critical temperature $T_c$, for the onset of superconductivity was raised to nearly 80 K. by C.W. Chu and coworkers (M. K. Wu, J.R. Ashburn, C.J. Tang, P.H. Hor, R.L. Meng, L. Gao, Z. J. Huang, Y. Q. Wang and C. W. Chu, Phys. Rev. Lett. 58 908 (1987)). This was achieved by changing the composition to yttrium barium copper oxide, approximated by the formula:

$$Y_{1.0}\,Ba_{1.8}Cu_{3.0}\,O_{6.3}$$

This formula, determined experimentally, is not exactly stoichiometric. It is believed that this lack of specific nonstoichiometry contributes most to the onset of superconductivity. The so-called 1:2:3 compound, composed of Y-Ba-Cu-O atoms, is prepared by the solid state reaction of the requisite oxides, vis:

$$Y_2O_3+2BaO+3\,CuO=2\,YBa_2Cu_3O_{6.5}.$$

It is now established (C.N.Rao et al, Nature, 327 185 (1987)) that high $T_c$ superconductivity in the Y-Ba-Cu-O system originates from a compound of stoichiometry: $YBa_2Cu_3O_{7-\mathfrak{q}}$, where "$\mathfrak{q}$" is a value less than 1.0. This compound has the structure of the ideal perovskite, $YBa_2Cu_3O_9$. Thus, the superconductor $YBa_2Cu_3O_{7-\mathfrak{q}}$ has about 25% fewer oxygen atoms present in the lattice as compared to the idealized cubic perovskite structure. This massive oxygen deficiency means that instead of the conventional three-dimensional crystalline cubicstacking array of the perovskite, a unique layered structure results. A loss of even more oxygen atoms in this structure gives rise to the semiconductor $YBa_2Cu_3O_6$. The chain of copper atoms associated with a chain of oxygen atoms is believed to be the key to superconducting behavior. Yet the above description is an idealized one and the actual distinct structural conformation has not yet been delineated. Note that there appear to be extra oxygen atoms in the superconducting unit cell, compared to that of the semiconductor.

To date, most of the high-$T_c$ superconducting ceramic compositions announced to date are based on cuprate compounds having $Cu\text{-}O_2$ layers as part of the structure. Some of these have included:

Bismuth Strontium Calcium Copper Oxide :

| |
|---|
| $Bi_2\ Sr_{3-x}\ Ca_x\ Cu_2\ O_{8+y}$<br>$T_c = 114$ K. |

Thallium Calcium (Barium) Copper Oxide:

| |
|---|
| $Tl\ Ba_2\ Ca\ Cu_2\ O_7$<br>$Tl\ Ba_2\ Ca_2\ Cu_3\ O_9$<br>$Tl\ Ba_2\ Ca_3\ Cu_4\ O_{11}$<br>$Tl\ Ba_2\ Ca_4\ Cu_5\ O_{13}$<br>$T_c = 120$ K. |

Lead Strontium Lanthanide Copper Oxide

| |
|---|
| $Pb_2Sr_2(Nd_{0.76}Sr_{0.24})Cu_3O_{8+x}$<br>$T_c = 77\ K.$ |

In the last compound given, the $CuO_2$ - sheets are present but there is also a PbO-Cu-OPb sandwich as well, not observed in ceramic superconductors prior thereto. The copper ions in this sandwich are monovalent and each is coordinated, above and below, to two oxygen atoms in the PbO layers. The copper atoms in the $CuO_2$ sheets have an average valence of about 2.25, which is consistent with previously discovered cuprate compounds, given above. However, the presence of $Cu^+$ atoms lowers the average valence of copper ions in the new structure to below 2.0, which is atypical. Indeed, preparation conditions needed to prepare these compounds includes a mildly reducing atmosphere so as not to oxidize $Pb^{2+}$ to $Pb^{4+}$.

There have also been some compositions announced, based on a copper-free composition, vis:

$BaO\text{-}\ K_2O\ \text{-}\ Bi_2O_3$

This compound is said to become superconducting at about 30 K. While copper-oxide superconductors exhibit layered structures that carry current efficiently only along certain planes, this new material is a three-dimensional network of bismuth and oxygen with properties that are much less sensitive to crystallographic direction. It is hoped that compositions will be discovered in this system with temperature properties that rival those of copper-bearing compounds.

The main advantage to superconducting compositions with higher $T_c$ values is that they can operate at liquid nitrogen temperatures (78 K.), thus avoiding the need to use liquid helium. Superconducting ceramic compositions are normally prepared by weighing out specific quantities of selected oxides. The combination is thoroughly mixed by conventional means and then fired at elevated temperatures above about 950 C. The induced solid state reaction causes the formation of the desired ceramic composition and structure. Further annealing in an oxygen atmosphere has been found to improve the superconducting properties of the Y-Ba-Cu-O compound. The produced powder is then processed by conventional means to form a bar (by compaction) which is then used as the superconducting medium.

I have found that my new invention employing high critical temperature superconducting ceramics to form the superconducting coils of the instant invention eliminates many of the problems associated with the design of electromagnetic and coil guns of the prior art.

The DC powered hybrid coil gun consists of a standard barrel, a magnet winding wrapped around the barrel, a large mass piston and a projectile. A conventional gun can be modified to operate as a direct-current powered hybrid-coil gun to accelerate projectiles to high velocities and frequencies which cannot otherwise be achieved. The gun arrangement of the instant invention facilitates collision between the large mass piston and a small mass projectile, thereby resulting in velocity amplification. Said collision is accomplished through the magnetic field interaction between the piston and an external field, between the projectile and the external winding, and between the piston and the projectile. The use of high critical temperature superconducting coils eliminates the need for using liquid helium. The external field is charged prior to firing of the gun, using a DC power supply. The external field decay during firing has been found to be negligible and multiple shots can be fired, facilitated by the presence of the superconductive external field winding.

The main components of the direct-current powered hybrid-coil gun are: the gun barrel, the external magnet windings, the piston, and the projectile.

The barrel has a standard conventional winding which is tapered in the combustion region. It is only subject to gaseous pressure and not to magnetic forces. The barrel wall can thus be made thin if the gaseous pressure is reduced.

The magnet design consists of a selected superconducting winding which produces an axially tapered field. It can be made from conducting materials such as metals, coated with a selected superconductor. Low current and low voltage is acceptable to charge the magnet if charging is done over a sufficiently long time.

The piston has a conductive winding which is thermally insulated from the high temperature combustion products. This can be achieved by embedding a metallic winding in a ceramic matrix. The piston also has a conductive windings and requires no insulation since it is not in contact with the combustion products.

Propellants or explosives are used to power the gun and the following sequence of events takes place during operation:

(a) The piston is accelerated by the high pressure gas generated in the barrel.

(b) The piston, reaching a certain velocity, approaches the external solenoid region. The piston is thus subjected to a positive field gradient and is thus subject to a decelerating magnetic force.

(c) Current is induced in the piston windings as it moves in the external magnetic field. Initially, the current in the piston will be in the opposite direction to the current in the external windings. The external magnet current also increases.

(d) The increase in the solenoid current induces current in the projectile windings. The projectile is placed in a low field gradient region near the center of the magnet windings, so as to have sufficient time for charging its coil.

(e) The currents induced in the piston and the projectile windings are initially in the same direction. The current in the external winding flows in the opposite direction.

(f) The projectile is initially placed in a negative field gradient producing accelerating magnetic forces.

The operation described above is equivalent to the collision of two objects and is defined here as magnetic collision. This will result in velocity multiplication and projectile velocities in excess of 4 km/s. Such system is also suitable for space launching.

The application of high critical temperature superconductors makes the use of the direct-current powered hybrid-coil gun of my new invention practical since no liquid helium will be required. It is preferred, but not necessary, to use a superconducting winding for the piston, and/or the projectile, since they carry current for a short time.

In the operation of my new invention, current in the piston windings decreases as the piston moves away from the positive field gradient region into the negative field gradient region. The piston is first accelerated and is then decelerated as the current reverses. A switch is opened when the velocity reaches zero so that said piston can be retrieved and repetitively used.

Simultaneous multiple firing is also possible . The external solenoid winding decelerating the piston is used to charge a number of solenoids. These solenoids are used to simultaneously accelerate the multiple projectiles.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
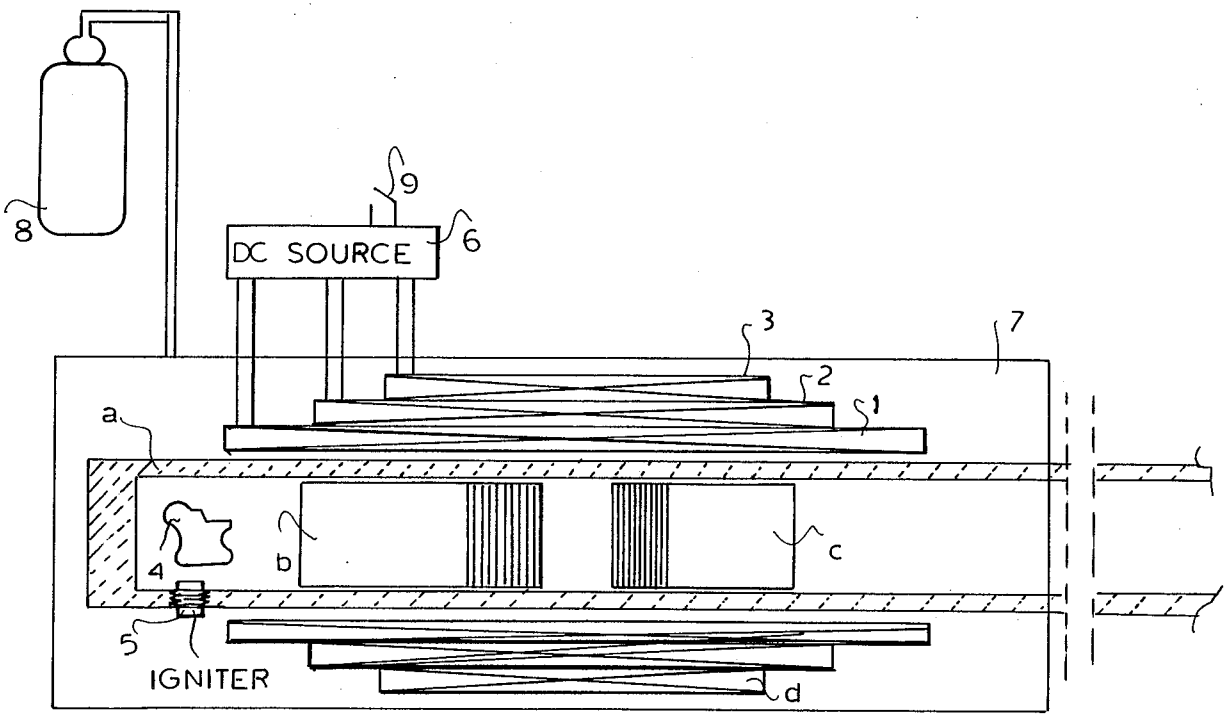
FIG. 1 is a cross-sectional view through a hybrid coil gun utilizing superconducting elements.
Figure 3B:
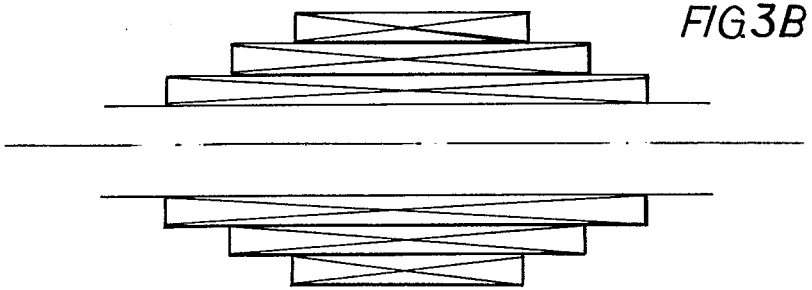
FIG. 3B is a diagram showing the coil arrangement associated with the diagram of FIG. 3A.
Figure 3A:
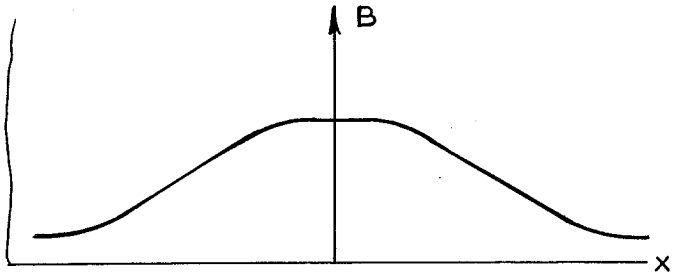
FIG. 3A is a diagram of the magnetic field distribution in which magnetic field strength is applied along the ordinate versus displacement along the abscissa for the region surrounded by the solenoid coils.

FIG. 1 shows a hybrid coil gun according to the invention in which the barrel a of a nonmagnetic material which can be a ceramic or a metal having low magnetic susceptibility is surrounded by three coils d respectively represented at 1, 2 and 3 to generate, along the barrel a generally tapered field strength characteristic of the type shown in FIG. 3A in which the field strength is plotted as a function of distance along the barrel.

A projectile b is received within the barrel downstream from a propellant mass 4 which can be ignited by an igniter 5. In general, the mass 4 can be gun powder or the like ignited by a spark from the igniter 5, although any other selectively detonatable means for producing propellant gases can be used.

Located specifically downstream of the midpoint of the field strength characteristic is a projectile c which can be magnetically propelled as will be described in greater detail hereinafter. The coils 1–3 can be energized by a direct-current source 6 which charges these coils. The coils are composed of wire, film, bands or the like of one of the high-temperature superconductive materials previously described.

The portion receiving the coil means 1, 2, 3 can be enclosed in a chamber 7 which can be supplied with nitrogen or some other coolant, e.g. from a tank 8, the latter representing cooling means for bringing the coil temperature to superconductivity temperature, i.e. a temperature below the critical temperature $T_c$ of the superconductor. The cooling means 7, of course, also serves to cool the piston b and the projectile c to the critical temperature $T_c$ of their respective superconductor windings described in connection with FIGS. 2A and 2B.

The projectile can be, for example, a satellite to be launched by the motion into space or any other projectile.

In operation, with the coil means 1, 2, 3 charged to create a magnetic field as shown in FIG. 3A, the firing of the propellant mass will generate propellant gases to drive the piston b to the right. The tapering magnetic field encountered by the coil of the winding of the piston induces a current flow therein and the resulting magnetic field induces a current pulse in the coil means which is superimposed upon the direct-current field thereof and induces a magnetic pulse which drives the projectile c to the right with amplified velocity and without, of course, any direct contact between the piston and the projectile.

Switch means represented diagrammatically at 9 can be actuated to deenergize the coils 1–3 or to quench the superconductor, or field reversal may be generated to draw the piston b back into its original position for the firing of another projectile and a fresh mass of propellant material can be introduced through a breach in the barrel (now shown) or by any other means.

Figure 2B:
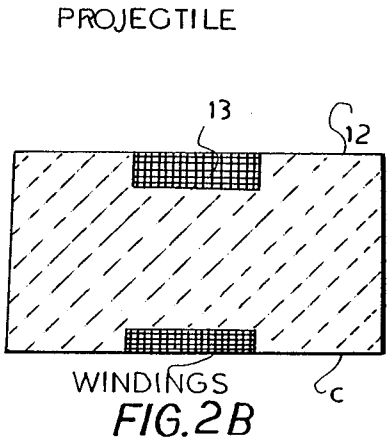
FIG. 2B is a cross-sectional view of a projectile adapted to be ejected from a smaller diameter portion of the barrel receiving the piston of FIG. 2A.
Figure 2A:
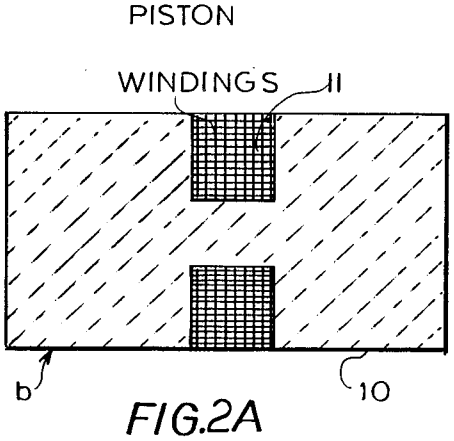
FIG. 2A is a cross-sectional view of a piston for use in the apparatus of FIG. 1.

As can be seen from FIG. 2A, the piston b can comprise a body (e.g. of ceramic) 10 formed with a closed-loop winding 11 composed of one of the high-temperature superconductors previously described whereas the projectile c of FIG. 2B is likewise composed of a body 12 (e.g. of ceramic) and a closed-loop superconductor winding 13.

Figure 4:
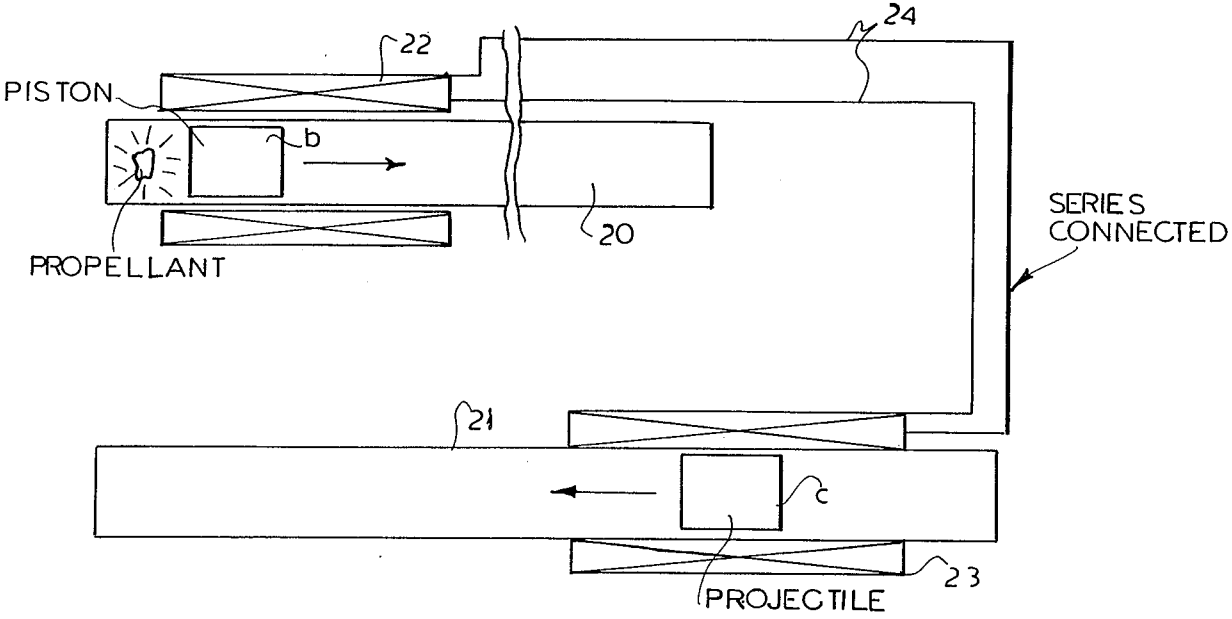
FIG. 4 is a diagrammatic cross-sectional view illustrating a reduced recoil hybrid coil gun according to the invention.
Figure 5:
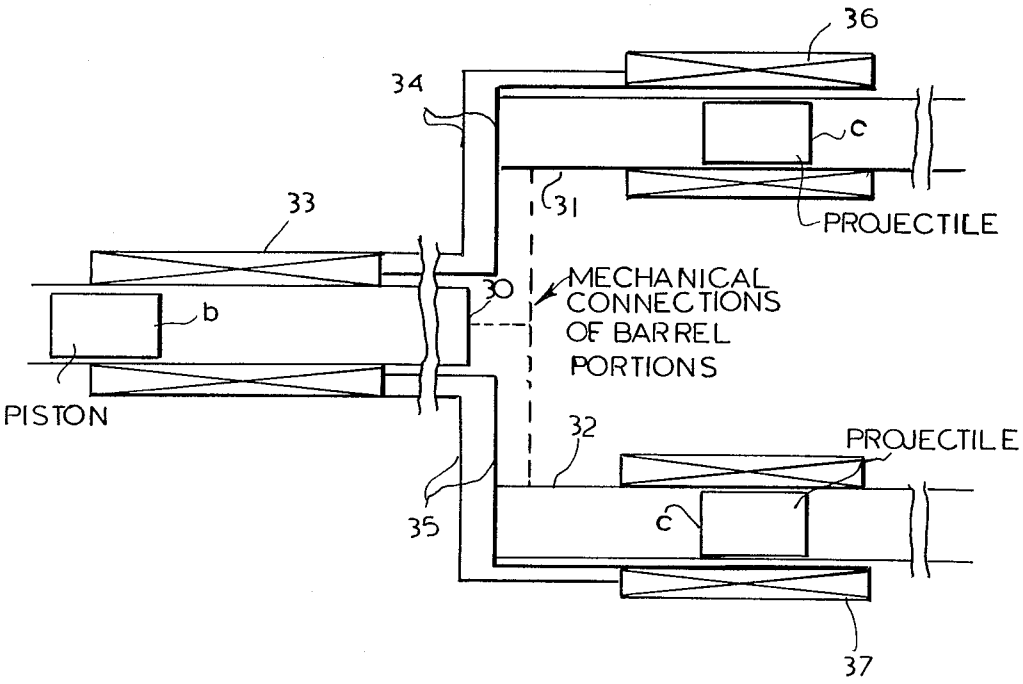
FIG. 5 is another diagrammatic cross section showing a multiple projectile coil gun.

As can be seen from FIG. 4, the coil means need not comprise the coil assembly shown in FIG. 1 in which tapered fields tapered in opposite directions lie on opposite sides of a median plane, but can comprise spaced-apart coils. For example, here the barrel means is formed by two barrels 20 and 21, respectively receiving the piston b and the projectile c.

The barrel 20 is surrounded by the coil 22 composed of a superconductor and series connected with a coil 23 surrounding the barrel 21 so that the current pulse generated by propellant of the piston is transmitted by conductors 24 to the coil 23 to propel the projectile. The means for charging the coils 22 and 23, namely, a direct-current source, and for cooling the gun to a temperature below the critical temperature $T_c$ of the superconductors may be the same as has been illustrated in FIG. 1. The downstream portion of the barrel faces in a direction opposite a direction in which the upstream portion faces and the upstream and downstream portions can be mechanically connected together to minimize recoil.

The principle of FIG. 4 is also applicable to the firing of a plurality of projectiles. Here the barrel means comprises a piston barrel 30 and projectile barrels 31, 32. The piston b, driven by a propellant as previously described but not illustrated in this Figure, cooperates with the magnetic field of coil 33 to generate the current pulse which is applied by the conductors 34 and 35 to the coils 36 and 37, respectively, surrounding the barrel portions 31 and 32 to magnetically propel the projectile c within these barrels to the right. The closed-loop portion of the coil means is here connected electrically in parallel to a plurality of further windings on respective downstream portions of the means defining the barrel for propelling respective projectiles therefrom.

I claim:

1. A hybrid coil gun, comprising:

a projectile formed with at least one closed-loop electromagnet winding;

a piston formed with at least one closed-loop electromagnet winding;

means defining at least one barrel receiving said projectile and from which said projectile can be electromagnetically propelled;

coil means on the barrel having at least a portion magnetically coupling to said closed-loop winding of said projectile for magnetically propelling said projectile from said barrel, said coil means comprising a closed-loop portion generating an external field and magnetically coupling to said closed-loop winding of said piston to decelerate said piston and generate by induction a current pulse for magnetically propelling said projectile; and means for applying a chemical propellant to said piston to drive said piston through said closed-loop portion of said coil means and said external field, whereby said current pulse is induced, the closed-loop portion generating an external field of axially tapering field strength.

2. The hybrid coil gun defined in claim 1, further comprising a direct-current source connectable across said closed-loop portion of said coil means for charging said external field.

3. The hybrid coil gun defined in claim 2 wherein at least said closed-loop portion of said coil means is composed of a superconductor.

4. The hybrid coil gun defined in claim 3 wherein said superconductor is a high critical temperature superconductor.

5. The hybrid coil gun defined in claim 3 wherein said superconductor is a low critical temperature superconductor, further comprising means for cooling said coil means.

6. The hybrid coil gun defined in claim 3 wherein at least one of said closed-loop windings is composed of a superconductor.

7. The hybrid coil gun defined in claim 6 wherein both of said closed-loop windings are composed of a superconductor.

8. The hybrid coil gun defined in claim 6 wherein said superconductor of said one of said closed-loop windings is a low critical temperature superconductor, further comprising means for cooling said means defining said at least one barrel.

9. The hybrid coil gun defined in claim 6 wherein said superconductor of said one of said closed-loop windings is a high critical temperature superconductor, further comprising means for cooling said means defining said at least one barrel.

10. The hybrid coil gun defined in claim 1 wherein said closed-loop winding of said piston is thermally insulated from said means for applying a propellant to said piston.

11. The hybrid coil gun defined in claim 11 wherein said means for applying a propellant to said piston includes a combustion chamber in said means defining said at least one barrel and means for initiating detonation of an explosive composition received in said chamber.

12. A hybrid coil gun, comprising:

a projectile formed with at least one closed-loop electromagnet winding;

a piston formed with at least one closed-loop electromagnet winding;

means defining at least one barrel receiving said projectile and from which said projectile can be electromagnetically propelled;

coil means on the barrel having at least a portion magnetically coupling to said closed-loop winding of said projectile for magnetically propelling said projectile from said barrel, said coil means comprising a closed-loop portion generating an external field and magnetically coupling to said closed-loop winding of said piston to decelerate said piston and generate by induction a current pulse for magnetically propelling said projectile; and means for applying a chemical propellant to said piston to drive said piston through said closed-loop portion of said coil means and said external field, whereby said current pulse is induced, said closed-loop portion of said coil means being located along an upstream portion of said barrel and being connected to a further winding on a downstream portion of said barrel for propelling said projectile.

13. The hybrid coil gun defined in claim 12 wherein said downstream portion of said barrel faces in a direction opposite a direction in which said upstream portion faces and said upstream and downstream portions are mechanically connected together to minimize recoil.

14. The hybrid coil gun defined in claim 13 wherein said closed-loop portion of said coil means is connected electrically in parallel to a plurality of further windings on respective downstream portions of said means defining said barrel for propelling respective projectiles therefrom.

15. A method of operating a hybrid coil gun which comprises the steps of:

(a) firing a combustible composition to produce a gaseous propellant;

(b) driving a piston formed with at least one closed-loop electromagnet winding through a means defining at least one barrel receiving a projectile and from which said projectile can be electromagnetically propelled and through a coil means on said barrel having at least a portion magnetically coupling to a closed-loop winding of said projectile for magnetically propelling said projectile from said barrel, said coil means comprising a closed-loop portion generating an external field and magnetically coupling to said closed-loop winding of said piston to decelerate said piston and generate by induction a current pulse for magnetically propelling said projectile; and (c) maintaining said field charged.

16. The method defined in claim 15 wherein said field is maintained charged by forming said coil means of a superconductor having a critical temperature $T_c > 23°$ K. and cooling at least said coil means below said critical temperature.

17. The method defined in claim 15 wherein said current pulse is applied to a plurality of windings, each propelling a respective projectile.

18. The method defined in claim 16, further comprising the steps of forming at least one of said closed-loop windings as a superconductor and cooling it below the critical temperature of the superconductor forming said one of said closed-loop windings.

* * * * *